US007876034B2

(12) United States Patent
Wei et al.

(10) Patent No.: US 7,876,034 B2
(45) Date of Patent: Jan. 25, 2011

(54) FIELD EMISSION LAMP WITH TUBULAR-SHAPED HOUSING

(75) Inventors: Yang Wei, Beijing (CN); Liang Liu, Beijing (CN); Lin Xiao, Beijing (CN); Feng Zhu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 242 days.

(21) Appl. No.: 11/951,151

(22) Filed: Dec. 5, 2007

(65) Prior Publication Data

US 2008/0136312 A1 Jun. 12, 2008

(30) Foreign Application Priority Data

Dec. 8, 2006 (CN) ..... 2006 1 0157376

(51) Int. Cl.
*H01J 5/48* (2006.01)

(52) U.S. Cl. ..... 313/318.11; 313/272; 313/495; 313/635

(58) Field of Classification Search ..... 313/9, 313/271–273, 310, 318.11, 495–497, 635
See application file for complete search history.

(56) References Cited

U.S. PATENT DOCUMENTS 5,600,200 A * 2/1997 Kumar et al. ..... 313/346 R
6,008,595 A 12/1999 Fink et al.
2004/0061429 A1* 4/2004 Sakai et al. ..... 313/491
2006/0017370 A1 1/2006 Wei et al.
2006/0022576 A1 2/2006 Wei et al.
2006/0146561 A1* 7/2006 Gu et al. ..... 362/560
2006/0197424 A1* 9/2006 Takata ..... 313/306
2006/0197426 A1 9/2006 Chen
2007/0057619 A1 3/2007 Chou et al.
2007/0278931 A1* 12/2007 Mii ..... 313/489

FOREIGN PATENT DOCUMENTS

CN 1750227 A 3/2006
TW 200618033 6/2006
TW I265356 11/2006

* cited by examiner

*Primary Examiner*—Bumsuk Won
(74) *Attorney, Agent, or Firm*—Jeffrey T. Knapp

(57) ABSTRACT

A field emission lamp (2) includes a tubular-shaped housing (20), a first electrode (22), an electron emitting layer (24), a second electrode (26), and a fluorescent layer (28). The housing (20) has an inner surface. The first electrode (22) is centrally and longitudinally accommodated in the housing (20). The electron emitting layer (24) is disposed on the first electrode (22). The second electrode (26) is spaced apart from the first electrode (22) and includes a reflective layer (261). The reflective layer (261) is disposed on a portion of an inner surface of the housing (20). The fluorescent layer (28) is disposed on the reflective layer (261).

18 Claims, 3 Drawing Sheets

FIELD EMISSION LAMP WITH TUBULAR-SHAPED HOUSING

BACKGROUND OF THE INVENTION

1. Field of the Invention

The invention relates to field emission lamps and, particularly, to a carbon nanotube-based field emission lamp.

2. Description of Related Art

A display device, such as a LCD, often requires a backlight device installed at a rear side thereof to provide illumination. Typically, a cold cathode fluorescent lamp (CCFL) has been commonly used as a light source of the backlight device. The CCFL includes a sealed tube and a pair of electrodes respectively disposed at two ends of the sealed tube. A fluorescent layer is coated on an inner surface of the sealed tube. The sealed tube is filled with a mixture including an inert gas and a mercury-based substance. When electric voltage is applied to the electrodes, electrons are emitted and cause the mercury-based substance to discharge, thereby ultraviolet radiation is generated. The ultraviolet, in turn, strikes the fluorescent layer to result in visible radiation. However, the mercury-based substance, a prominent component of CCFL, is harmful to people and is a potentially dangerous pollutant.

Therefore, a field emission lamp, without using the mercury-based substance to achieve illumination, has been explored as an alternative light source for the backlight device. The field emission lamp includes a cathode electrode and an anode electrode disposed opposite to each other. An electron emitting layer is disposed on the cathode electrode. A fluorescent layer is disposed on the anode electrode and corresponding to the electron emitting layer. When a predetermined voltage is applied to the cathode electrode and the anode electrode, electrons emitted from the electron emitting layer collide against the fluorescent layer, and thereby visible light is generated.

As mentioned above, in such a backlight device using the field emission lamp, visible light is emitted in all directions from the fluorescent layer. That is, emitted light is not controlled to illuminate toward a particular direction.

What is needed, therefore, is a field emission lamp having high luminous efficiency to provide high luminance and in which light is emitted in a controlled, predetermined direction.

SUMMARY OF THE INVENTION

A field emission lamp is provided. In one embodiment, the field emission lamp includes a tubular-shaped housing, a first electrode, an electron emitting layer, a second electrode, and a fluorescent layer. The housing has an inner surface. The first electrode is centrally and longitudinally accommodated in the housing. The electron emitting layer is disposed on the first electrode. The second electrode is spaced apart from the first electrode and includes a reflective layer. The reflective layer is disposed on a portion of an inner surface of the housing. The fluorescent layer is disposed on the reflective layer.

Other advantages and novel features of the present field emission lamp will become more apparent from the following detailed description of preferred embodiments, when taken in conjunction with the accompanying drawings.

BRIEF DESCRIPTION OF THE DRAWINGS

Many aspects of the present field emission lamp can be better understood with reference to the following drawings. The components in the drawings are not necessarily to scale, the emphasis instead being placed upon clearly illustrating the principles of the present field emission lamp.

Figure 1:
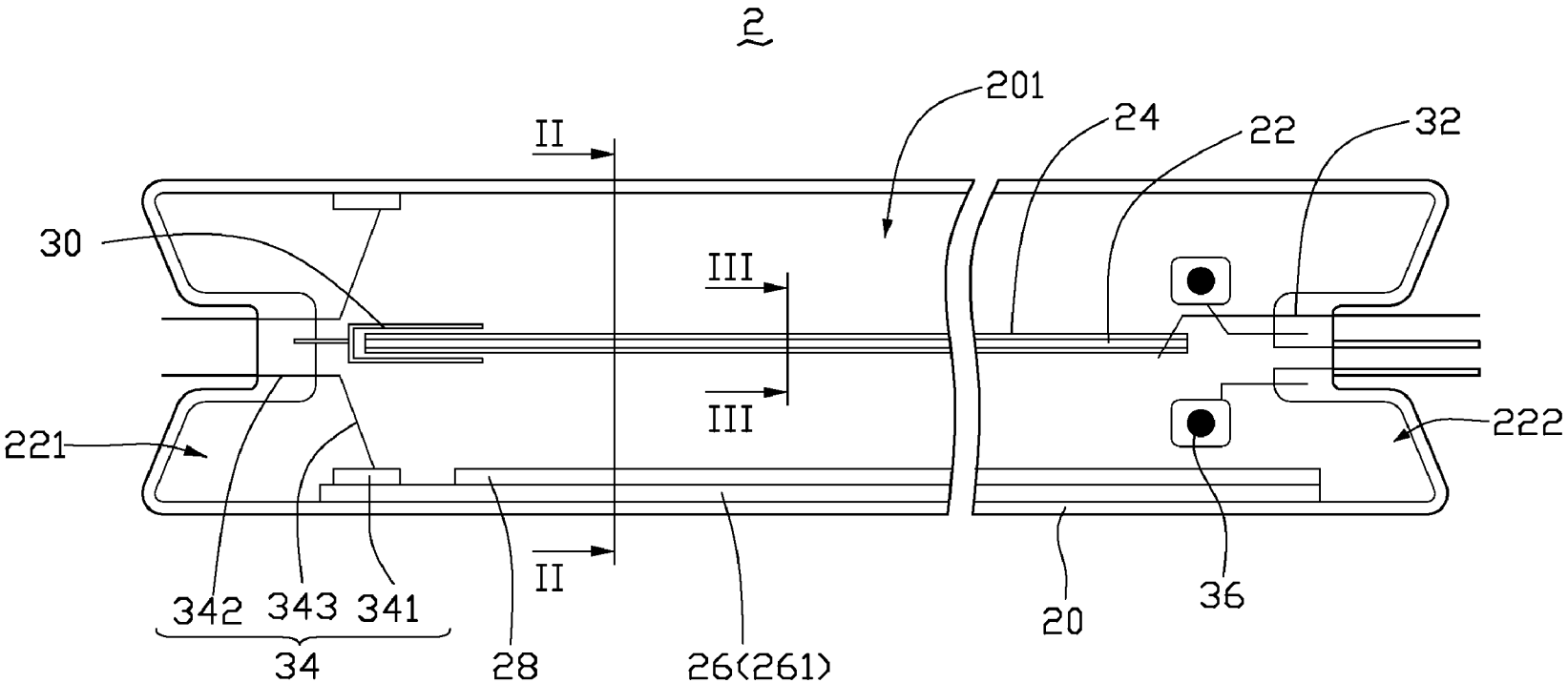
FIG. 1 is a schematic view of a field emission lamp, in accordance with a present embodiment.

Corresponding reference characters indicate corresponding parts throughout the several views. The exemplifications set out herein illustrate at least one preferred embodiment of the present field emission lamp, in one form, and such exemplifications are not to be construed as limiting the scope of the invention in any manner.

DETAILED DESCRIPTION OF THE INVENTION

Reference will now be made to the drawings to describe embodiments of the present field emission lamp, in detail.

Referring to FIG. 1, a field emission lamp, according to a present embodiment, is shown. The field emission lamp 2 includes a tubular-shaped housing 20, a first electrode 22, an electron emitting layer 24, a second electrode 26, and a fluorescent layer 28. In the present embodiment, the field emission lamp 2 is configured for acting as a light source to provide illumination.

In the present embodiment, the housing 20 is a sealed tube and thereby defines an accommodating space 201 therein. The housing 20 has an inner surface. Additionally, the housing 20 is made of a transparent material, such as glass. The housing 20, in operation, is an evacuated chamber and is designed so as to maintain a sufficient operational vacuum level over the lifetime of the device. Advantageously, the housing 20 is cylindrical in shape and has a central, longitudinal axis.

Figure 2:
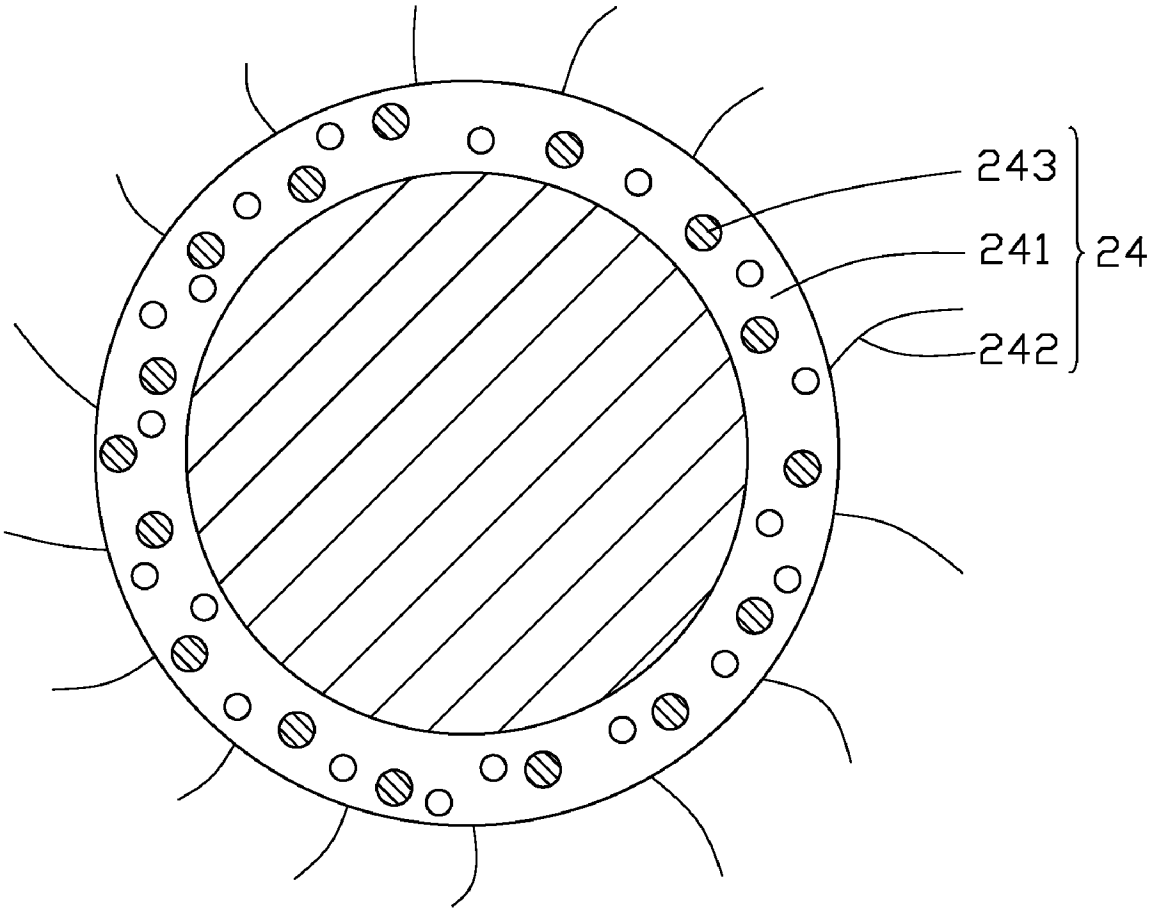
FIG. 2 is a sectional view of a first electrode of the field emission lamp of FIG. 1 along a line I-I.
Figure 3:
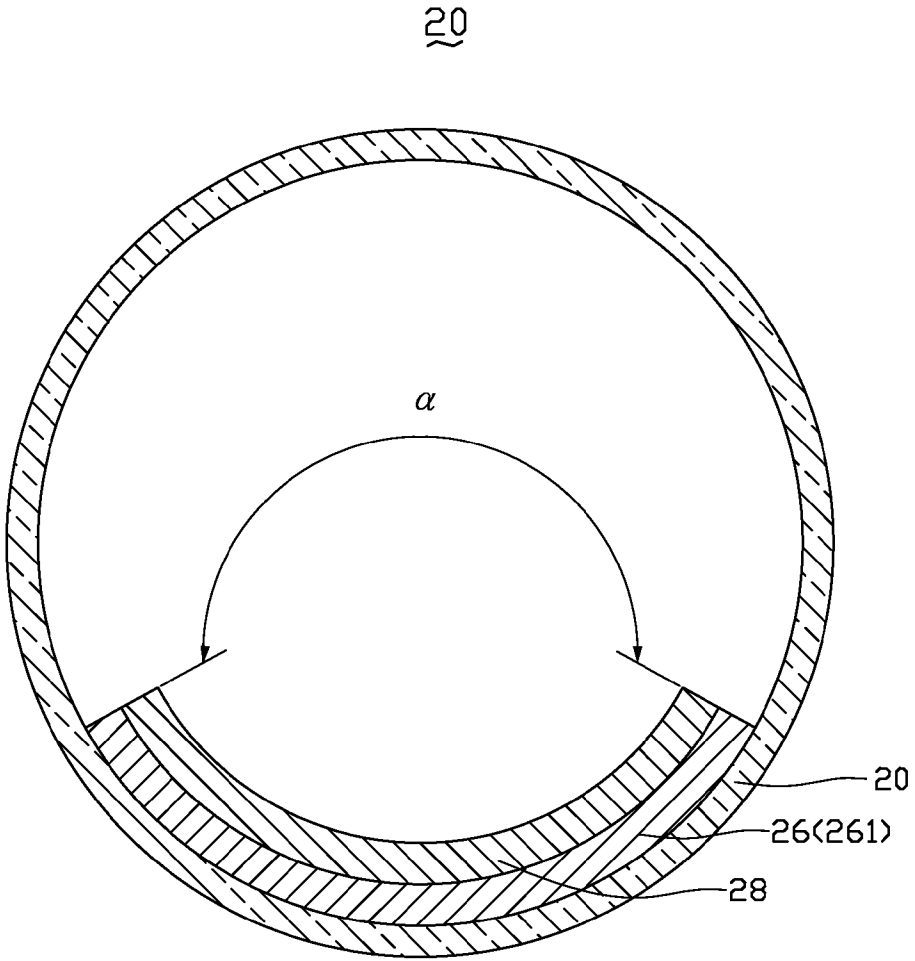
FIG. 3 is a sectional view of a housing of the field emission lamp of FIG. 1 along a line II-II.

The first electrode 22 is centrally and longitudinally accommodated in the housing 20, e.g., coaxially therewith. That is, the first electrode 22 is in the accommodating space 201 of the housing 20. In the present embodiment, the first electrode 22 has a cylindrical shape (as shown in FIG. 2) or a filamentary shape. Particularly, the cylindrical first electrode 22 has a diameter in an approximately range from 0.1 mm to 3 mm. In addition, the first electrode 22 is made of an electrically conductive material, such as a metal or an alloy thereof. Rather suitably, the first electrode 22 is made of silver (Ag) or an alloy thereof. Referring to FIG. 1, one end of the first electrode 22 is fastened to one end 221 of the housing 22 through/via a nickel tube 30 while another end of the first electrode 22 is fastened to another end 222 of the housing 22 through/via an electric conduction element 32 (i.e., a conductor element). The electric conduction element 32 extends to the outside of the housing 22 so as to be capable of connecting with an external power supply. The housing 22, in turn, is hermetically sealed around the electric conduction element 32. The external power supply is used to apply a predetermined voltage to the first electrode 22. Alternatively, the first electrode 22 can directly extend, in a hermetic fashion, to the outside of the housing 20 and connect with the external power supply (not shown in FIG. 1).

Furthermore, an elastic element, such as a spring, can be disposed between the first electrode 22 and the electric conduction element 32. In such a manner, when the external power supply is on, the elastic element is configured for compensating for expansion and/or contraction of the first electrode 22, due to heating/thermal effects (e.g., the first electrode heating and expanding when power supplied thereto; and cooling and shrinking once power is off).

Referring to FIG. 2, the electron emitting layer 24 is coated on the circumference of the first electrode 22. In the present embodiment, the electron emitting layer 24 is comprised of glass 241, a plurality of carbon nanotubes 242, and a plurality of electrically conductive particles 243. In such case, the plurality of carbon nanotubes 242 is configured to act, when considered together, as an electron emitter. In the present embodiment, the carbon nanotubes 242 are extended in a direction towards the second electrode 26 from the surface of the electron emitting layer 24. However, the material for use as the electron emitter is not limited to the carbon nanotubes 242, as another field emission material having a sufficiently low work function, such as tungsten, also can be applied. In the present embodiment, the electrically conductive particles 243 are, beneficially, metal particles.

The second electrode 26 is spaced apart from the first electrode 22 by a predetermined distance. The second electrode 26 includes a reflective layer 261 disposed (e.g., directly) on a portion of an inner surface of the housing 20. Particularly, the reflective layer 261 is disposed along an axial direction of the housing 20. The reflective layer 261 is configured to reflect light generated by electrons from the electron emitter to collide against the fluorescent layer. In addition, an area upon which the reflective layer 261 disposed is determined based on a need for allowing the emitted light to be directed in a particular luminance direction. For example, in order to allow emitted light to collectively radiate from a given side/portion of the housing 20, the reflective layer 261 should be disposed on the diametrically opposite side of the housing 20. Therefore, in such the field emission lamp 2 with the reflective layer 261 is capable to provide high luminance and high luminous efficiency in the particular luminance direction. In the present embodiment, the reflective layer 261 is disposed along an angular portion of the housing 20 of approximately 10°~180° to generate a sufficient yet relatively concentrated beam of light.

The reflective layer 261 is, usefully, comprised of an electrically conductive material, is opaque, and, of course, is highly reflective. In the present embodiment, the electrically conductive material is a metal selected from a group consisting of silver (Ag), aluminum (Al), and alloys incorporating such metals. In the present embodiment, a reflective layer 261 made of silver can be formed, e.g., using a silver mirror reaction process. A reflective layer 261 made of aluminum can be, e.g., deposited on the inner surface of the housing 20 via a vacuum deposition process.

The reflective layer 261 is connected with the external power supply by an electric conduction assembly 34. In such case, as shown in FIG. 1, the electric conduction assembly 34 includes a lead pad 341, a lead rod 342, and a lead wire 343, connecting with the lead pad 341 and the lead rod 342. In such case, the lead pad 341 is disposed on the reflective layer 261, while the lead rod 342 is fastened to the end 221 of the housing 20 and extends, in a hermetic fashion, to the outside of the housing 20 for electrically connecting with the external power supply. By way of using the lead wire 343 to electrically connect the lead pad 341 and the lead rod 342, a predetermined voltage from the external power supply is applied to the second electrode 26. However, the way to connect the second electrode 26 with the external power supply is not limited to what is mentioned above. Alternatively, the reflective layer 261 can be connected with the external power supply just through an electric conduction rod or an electric conduction filament. That is, one end of the electric conduction rod/filament is connected to the reflective layer 261 or the lead pad 341 disposed on the reflective layer 261, while another end of the electric conduction rod/filament is connected to the external power supply.

The fluorescent layer 28 is disposed on the reflective layer 261, and a portion of the reflective layer 261 is exposed and thereby configured for facilitating the electric conduction assembly 34, in particular, to be attached to the lead pad 341. In addition, the carbon nanotubes 242 of the first electrode 22 directly point to the fluorescent layer 28. The fluorescent layer 28 is made of material with a high efficiency, low applied voltage, and high luminance. In practice, the fluorescent layer 28 can, e.g., be comprised of a white fluorescent material or a colored fluorescent material.

In addition, referring to FIG. 1, the field emission lamp 2 further includes at least one getter 36 accommodated in the housing 20. In the present embodiment, two getters 36 are fastened at the end 222 of the housing 20. The getters 36 are configured for absorbing the residual gases to make sure that the housing 20 is maintained in a vacuum state.

When the predetermined voltage is applied to the first electrode 22 and the second electrode 26, an electric field is formed between the reflective layer 261 and the electron emitting layer 24. Electrons are emitted from the carbon nanotubes 242 and are accelerated to impinge on the fluorescent layer 28, under the effect of the electric field. As a result, colored light is emitted from the fluorescent layer 28 made of the color fluorescent material, while white light is emitted from the fluorescent layer 28 made of the white fluorescent material. Moreover, by way of disposing the reflective layer 261 over a limited angular range of the housing interior, the light emitted from the fluorescent layer 28 (given that the reflective layer 261 acts as an anode for activating emission and as a reflector for redirecting emitted light) can be controlled to emit/radiate in a particular direction, according to the distribution of the reflective layer 261 disposed.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A field emission lamp, comprising:

a tubular-shaped housing having an inner surface, the inner surface comprising a reflecting area and an emitting area, the reflecting area being opposite to the emitting area;

a first electrode centrally and longitudinally accommodated in the housing, the first electrode being fastened to one end of the tubular-shaped housing, through which the first electrode is electrically connected to an external power supply;

an electron emitting layer disposed on the first electrode;

an opaque reflective layer acting as a second electrode spaced apart from the first electrode, the reflective layer being disposed only on the reflecting area of the housing, the reflective layer being electrically connected to the external power supply; and a fluorescent layer disposed on the reflective layer such that the reflective layer is sandwiched between the fluorescent layer and the inner surface of the housing;

wherein light irradiating the conductive reflective layer is only emitted out of the field emission lamp and is emitted via the emitting area.

2. The field emission lamp as claimed in claim 1, wherein the reflective layer comprises an electrically conductive material.

3. The field emission lamp as claimed in claim 2, wherein the electrically conductive material is a metal selected from a group consisting of silver, aluminum, and alloys thereof.

4. The field emission lamp as claimed in claim 1, wherein the reflective layer is disposed along an axial direction of the housing.

5. The field emission lamp as claimed in claim 4, wherein the reflective layer is disposed along an angular portion of the housing of approximately 10° to 180°.

6. The field emission lamp as claimed in claim 1, wherein the electron emitting layer comprises a plurality of carbon nanotubes extended in a direction towards the fluorescent layer from a surface of the electron emitting layer.

7. The field emission lamp as claimed in claim 1, wherein the first electrode has a cylindrical shape or a filamentary shape.

8. The field emission lamp as claimed in claim 1, further comprising: at least one getter accommodated in the housing.

9. The field emission lamp as claimed in claim 1, wherein the first electrode and the second electrode are electrically connected to the external power supply through opposite two ends of the tubular-shaped housing.

10. The field emission lamp as claimed in claim 1, wherein the first electrode is positioned at the center of the tubular-shaped housing.

11. The field emission lamp as claimed in claim 1, wherein the reflective layer is electrically connected to the external power supply through an electrical conduction assembly.

12. The field emission lamp as claimed in claim 11, wherein the electrical conduction assembly comprises a lead pad, a lead wire, and a lead rod, the lead pad being disposed on the reflective layer, the lead rod being fastened to an end of the tubular-shaped housing, and the lead wire being connected with the lead pad and the lead rod.

13. The field emission lamp as claimed in claim 1, wherein a nickel tube is disposed between a first end of the first electrode and a first end of the housing.

14. The field emission lamp as claimed in claim 13, wherein an electric conduction element is disposed between a second end of the first electrode and another end of the housing.

15. The field emission lamp as claimed in claim 14, wherein the electric conduction element extends to an exterior of the housing and is connected with the external power supply.

16. The field emission lamp as claimed in claim 1, wherein the electron emitting layer comprises a glass, a plurality of carbon nanotubes, and a plurality of electrically conductive particles.

17. A field emission lamp, comprising:

a tubular-shaped housing comprising an inner surface and a longitudinal axis, the inner surface comprising a reflecting area and an emitting area, the reflecting area being opposite to the emitting area;

a first electrode accommodated in the housing along the longitudinal axis, the first electrode being fastened to one end of the tubular-shaped housing, through which the first electrode is capable of being electrically connected to an external power supply;

an electron emitting layer disposed on the first electrode;

a second electrode spaced apart from the first electrode and disposed only on the reflecting area of the inner surface of the housing, the second electrode being opaque and capable of acting as a reflective layer, and the second electrode being electrically connected to the external power supply; and a fluorescent layer disposed on the second electrode such that the reflective layer is sandwiched between the fluorescent layer and the inner surface of the housing;

wherein light irradiating the conductive reflective layer is the only light emitted out of the field emission lamp and is emitted via the emitting are.

18. A field emission lamp, comprising:

a tubular-shaped housing comprising an inner surface and a longitudinal axis, the inner surface comprising a reflecting area and an emitting area, the reflecting area being opposite to the emitting area;

a first electrode accommodated in the housing along the longitudinal axis, the first electrode being fastened to one end of the tubular-shaped housing, through which the first electrode is electrically connected to an external power supply;

an electron emitting layer disposed on the first electrode;

a second electrode spaced apart from the first electrode and disposed only on the reflecting area of the housing, the second electrode comprising an opaque and conductive reflective layer, the reflective layer being electrically connected to the external power supply; and a fluorescent layer disposed on the conductive reflective layer such that the reflective layer is sandwiched between the fluorescent layer and the inner surface of the housing;

wherein the emitting area of the lamp is the only area in which light is emitted from the lamp.

* * * * *